United States Patent [19]

Hughes et al.

[11] 4,413,689

[45] Nov. 8, 1983

[54] PLURAL-PART EARTH BIT, AND AN IMPROVED BIT HEAD THEREFOR

[75] Inventors: Robert W. Hughes; James F. Cantrel, both of Easton, Pa.

[73] Assignee: Ingersoll-Rand Co., Woodcliff Lake, N.J.

[21] Appl. No.: 383,976

[22] Filed: Jun. 1, 1982

[51] Int. Cl.[3] ..... E21B 10/00

[52] U.S. Cl. ..... 175/409; 464/45; 285/92; 285/390; 411/38; 411/247; 279/1 ME; 279/1 W; 279/100

[58] Field of Search ..... 411/38, 247, 248–251, 411/262, 438, 1; 464/45–48; 403/343; 285/92, 390, 355, 333, 334; 175/320, 414, 409; 279/1 ME, 1 W, 99, 100, 101

[56] References Cited

U.S. PATENT DOCUMENTS

| | | | |
|---|---|---|---|
| 2,209,079 | 7/1940 | Gilman | 279/100 |
| 2,605,850 | 8/1952 | Kiekhaefer | 464/45 |
| 3,062,568 | 11/1962 | Andresen | 285/333 |
| 3,396,557 | 8/1968 | Moore, Jr. | 464/46 |
| 3,521,716 | 7/1970 | Fisher | 175/417 |
| 3,687,493 | 8/1972 | Lock | 285/333 |
| 3,756,628 | 9/1973 | St. Clair | 285/52 |
| 4,043,409 | 8/1977 | Walter | 175/414 |
| 4,362,450 | 12/1982 | Hasegawa | 411/1 |

FOREIGN PATENT DOCUMENTS

| | | | |
|---|---|---|---|
| 673769 | 7/1979 | U.S.S.R. | 411/1 |

*Primary Examiner*—William F. Pate, III
*Attorney, Agent, or Firm*—B. J. Murphy

[57] ABSTRACT

According to a depicted embodiment thereof, the novel earth bit comprises a shank having a threaded end and a bit head centrally bored and threaded to receive a shank. A stack of apertured discs, however, is interposed between the threaded bore or cavity in the bit head and the threaded end of the shank. The discs intimately engage, and bridge between, the shank and bit head threads, and communicate torque therebetween. The bit head cavity has a bearing surface or land upon which the discs are supported, and the shank has an annular shoulder which bears upon the stack and, thus, compressive forces are communicated from the shank to the bit head. The bit head, of the invention, then, comprises the aforesaid bit head, having the stack of discs secured therein by a retainer, for use, in a plural-part earth bit having a threaded shank.

33 Claims, 6 Drawing Figures

FIG. 1
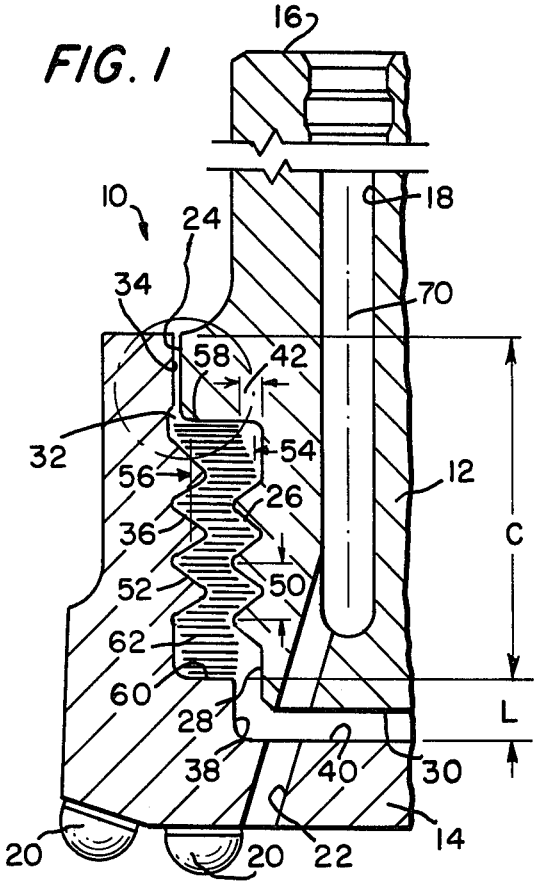
FIG. 2
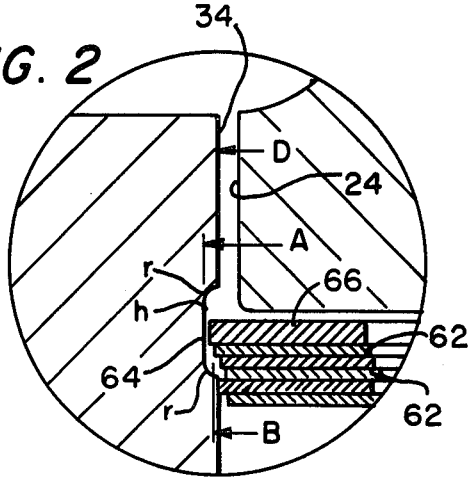
FIG. 4
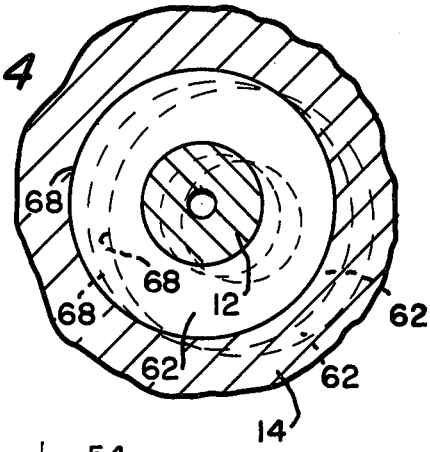
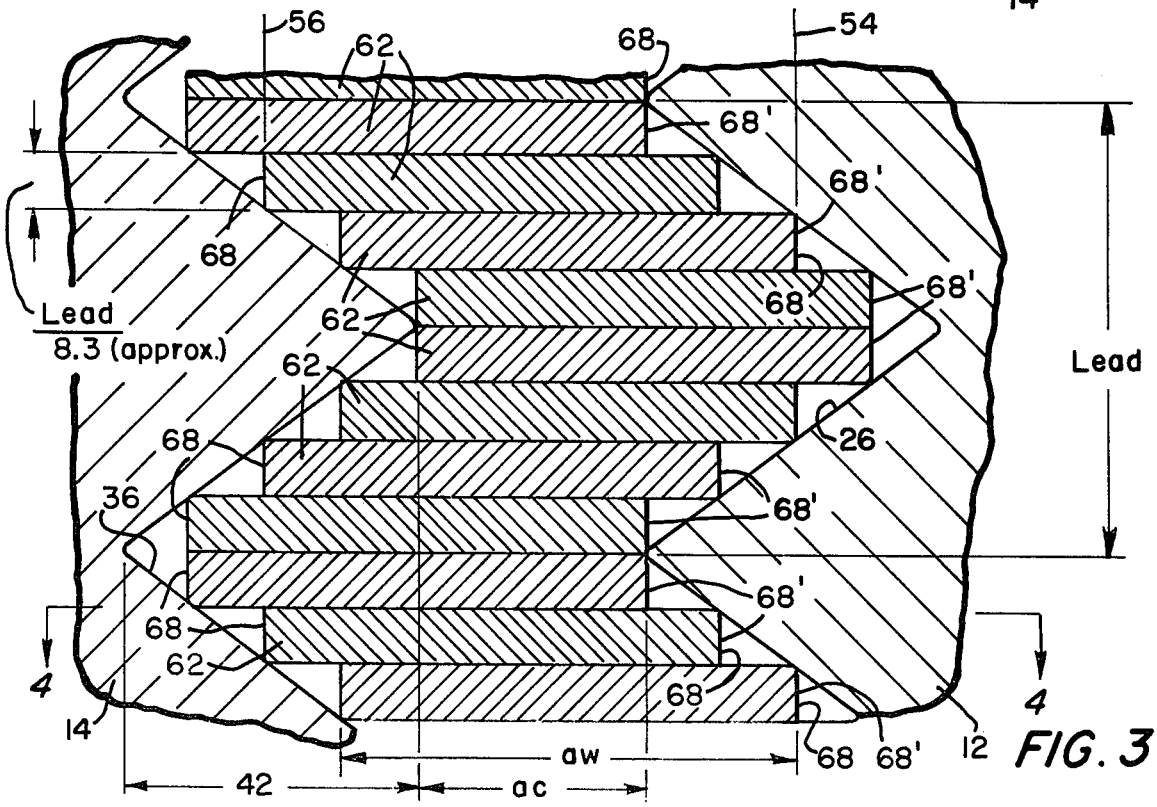
FIG. 3

PLURAL-PART EARTH BIT, AND AN IMPROVED BIT HEAD THEREFOR

This invention pertains to two (or more)-piece earth bits, and in particular to an improved plural-part earth bit, having a shank and a bit head, and to an improved bit head for use with a separate shank.

It is conventional to connect a bit head to a shank, in a two-piece earth bit, through a threaded connection which provides a solid contact therebetween, either (a) when the shank threads into and bottoms against the bit head, or (b) when a shoulder on the shank closes into engagement with an annular end of the bit head. When such bits are used in an earth-drilling machine, the latter acts as a continuous high energy impact wrench causing the threading between the shank and the bit head to progressively tighten, thus increasing the tensile stress in the regions adjacent to the bit head/shank interface. This can result in a transverse fatigue fracture of the bit head skirt in the plane of the shank bottom. A second mode of failure can exist as a fatigue fracture in the threaded shank. This fracture can be initiated by localized thread galling. In the event that the bit has not failed by either of the above modes, it is possible that the combined "Torque Wrench Action" and localized thread galling can result in a threaded connection that is difficult or practically impossible to detach.

It is an object of this invention to provide an improved, plural-part earth bit, and an improved bit head therefor, which are not subject to the aforesaid, prior art disadvantages.

It is particularly an object of this invention to set forth an improved bit head, for a plural-part, earth bit, said head having a central axis, and an axially-extended cavity formed therein; said cavity defining a first wall, substantially smoothly threaded and of a given pitch diameter, which circumscribes said axis, wherein the improvement comprises means lining said first wall defining a second, threaded wall, which circumscribes said axis; said defined second wall having a thread with a pitch diameter which is less than said given diameter; wherein said lining means comprises a plurality of lamina; each lamina of said plurality presents an individual, rigid, circular surface circumscribing said axis; the median of any one of said individual surfaces, of a plurality thereof, measured along a given radial plane, is disposed at a given distance from said axis; and the median of another such surface immediately adjacent to said one surface, measured along said plane, is disposed at a radial distance from said axis other than said given distance.

It is also an object of this invention to disclose an improved bit head, for a plural-part earth bit, said head having a central axis, and an axially-extended, circumferential, first wall, which circumscribes said axis, said first wall having a thread of a given pitch diameter, wherein in the improvement comprises: means lining said first wall defining a second, threaded wall, circumscribing said axis, having a pitch diameter which is less than said given diameter, wherein said lining means comprises a plurality of individual, rigid, circular elements; and each of said elements is rotatable relative to any other thereof.

Another object of this invention is to teach an improved, plural-part, earth bit, comprising a bit shank having a threaded end, and a bit head, said head having a central axis, and an axially-extended, circumferential, first wall, which circumscribes said axis, said first wall having a thread with a given pitch diameter, wherein in the improvement comprises means lining and engaging said first wall defining a second, threaded wall which circumscribes said axis, and which threadedly engages said threaded end of said shank; said defined second wall having a thread with a pitch diameter which differs from said given diameter; wherein said lining means comprises a plurality of lamina; each lamina of said plurality presents an individual, rigid, circular surface circumscribing said axis; and each lamina of said plurality thereof is rotatable relative to any other thereof.

Features of this invention comprise an earth bit which limits the torque that will be developed between the bit head and shank. Such torque is generated by the continual "impact wrench" type action associated with drilling machines in normal service. Another feature of this invention proceeds from an integration of the contact between the male and female thread of the bit and shank so that the load is distributed uniformly along the threads. The invention also provides a "stress wave check valve" so that a returning tensile stress wave will not be transmitted back into the shank from the bit. Additionally, it is believed that the invention provides a multiplicity of interfaces which serves to attenuate the peak of the cmpressive stress wave which is transferred from the bit shank to the bit head.

Further objects and features of this invention will become more apparent by reference to the following description, taken in conjunction with the accompanying figures, in which:

FIG. 1 is an axial cross-sectional view of portions of a plural-part bit, according to an embodiment of the invention, showing portions of a shank, bit head and an interposed stack of discs;

FIG. 2 is an enlarged detail of the circled area of FIG. 1;

FIG. 3 is a greatly enlarged illustration of a cross-section taken through a radial plane of the embodiment of FIG. 1;

FIG. 4 is a cross-section taken along section 4—4 of FIG. 3;

and

Figure 6:
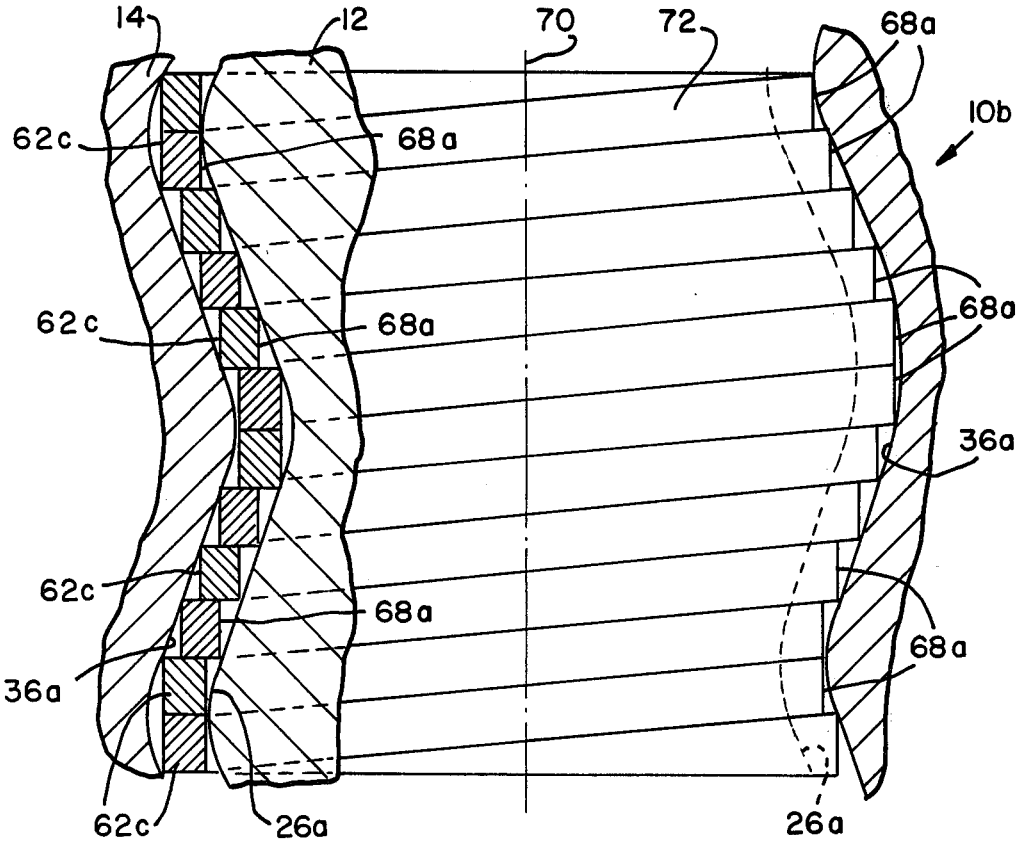

FIG. 6 is an illustration similar to that of FIG. 3 of a further alternative embodiment of the invention.

As shown in FIGS. 1 through 4, the novel, plural-part bit 10 consists of a bit shank 12 and a bit head 14. The bit shank 12 incorporates the standard features of a striking face 16 to accept impact energy from a piston (not shown), splines (not shown) to accept rotational torque from a drill chuck (not shown) and an exhaust passage 18. Bit head 14 incorporates the standard features of tungsten carbide inserts 20 and hole cleaning exhaust conduits 22 (only one is shown). Bit shank 12 terminates in cylindrical surface 24, a male thread 26, a cylindrical surface 28, and shank face 30. Bit head 14 incorporates a cavity 32 bounded by cylindrical bore 34, female thread 36, cylindrical bore 38, and bottom surface 40. Male thread 26 and female thread 36 are complimentary threads with the same thread depth 42 and thread lead 50, and are generated surfaces of revolution with a thread profile 52 that is, in this embodiment, a modified cosine curve. The thread profile provides for a low thread efficiency consistent with a low stress concentration factor, and the inherent property that all transverse sections of a thread profile are circles of the same diameter. This is consistent for either the male thread 26 or the female thread 36. However, the pitch diameter 54 of the male thread 26 is significantly smaller than the pitch diameter 56 of the female thread 36.

The volume between the male thread 26, the female thread 36, the bit shank shoulder 58 and the bit head shoulder 60 (the latter defining a bearing surface) is filled with a multiplicity of washer-type discs 62. The discs 62 have an outside diameter that is slightly less than the pitch diameter 56 of the female thread 36, and a concentric inside diameter that is slightly greater than the pitch diameter 54 of the male thread 26. The face area of the discs 62 is, in this embodiment, approximately equal to the area of the bit striking face 16. The ratio between the radial width of the discs 62 to the thickness thereof is a factor of approximately 6.25, in this exemplary embodiment. The discs 62 are, only by way of example, of a ferrous material. Other materials, of course, may be used, to wit: bronze. However, it is preferred that, whatever materials are used in forming the discs 62, the latter have a hardness that is less hard than the material of the bit shank 12 or the material of the bit head 14.

The discs 62 are assembled in the cavity 32 of the bit head 14 in the space bounded by bit head shoulder 60 and female thread 36. The discs 62 orient themselves so that inside diameter thereof approximates an elemental profile of the female thread 36. Thus, the male thread 26 of bit shank 12 is screwed into a female thread formed by the elementally oriented multiplicity of discs 62 which line and engage the wall of the bit head 14 in which the female thread 36 is formed. The height of the stack of discs 62 is such that, when bit shank shoulder 58 of bit shank 12 contacts the top of the stack in bit head 14, the striking face 16 is in the correct impact point location.

The cylindrical surfaces 24 and 28 of bit shank 12 have a slidable relationship with cylindrical bores 34 and 38, respectively, of bit head 14 and serve to resist any bending moment that may exist between bit shank 12 and bit head 14. A clearance space exists in cavity 32 between shank face 30 and bottom surface 40 of bit head 14.

In operation the striking face 16 of bit shank 12 is impacted by a rapidly reciprocating piston (not shown) while rotational torque is simultaneously transmitted through splines from a chuck (not shown). The torque from bit shank 12 is transmitted from male thread 26 through discs 62 to female thread 36 of bit head 14 where it is resisted by the impingement of the carbide inserts 20 encountered in normal drilling service. The transmitted torque causes the discs 62 to be compressed between the shank shoulder 58 of bit shank 12 and the bit head shoulder 60 of bit head 14. The compressive impact stress pulse travels from the striking face 16, through bit shank 12, through shank shoulder 58, through the stack of discs 62, through bit head shoulder 60, into bit head 14 and inserts 20 and into the breaking of rock (not shown) as a normal drilling action. Reactive energy would normally be transmitted through bit head shoulder 60 of bit head 14, through the shank 12, and into the chuck (not shown, which is part of a housing system). Since, according to the disclosed, inventive embodiment, the stress pulse must pass through a multiplicity of disc interfaces, between the bit shank 12 and the bit head 14, any reflected tensile wave will not be transmitted through the interfaces of the discs 62 from bit head 14 into bit shank 12. Hole cleaning is accomplished by compressed air flowing through exhaust passage 18 of bit shank 12 into the innermost end of cavity 32, between the shank face 30 and the bottom surface 40 of the bit head 14, through exhaust conduits 22 of bit head 14, and then between the bit face and the rock in the normal manner.

The tightness of the threaded connection incorporating the compressed multiplicity of discs 62 is a function of the drill power and the available torque, and is not a function of time as is the case in a rigid threaded connection subject to continuous impact wrenchtype torque. Thus, in essence, the torque, in this invention, attains a limited value.

The ability of the elemental discs 62 to individually longitudinally orient themselves in response to an applied load, in conjunction with the space available to accommodate local disc deformation, provides the ability to integrate the thread loading throughout the length of the threads.

Means are provided for retaining the discs 62 in the bit head 14. Such retention is accomplished by providing a low stress undercut 64 in the bit head 14 upper cylindrical surface or bore 34, the latter comprising an upper stabilizing bearing bore. The low stress undercut 64 approximates an ellipse in that it is formed by two radii (r) bounding a cylindrical bore (h). A retaining spacer 66 is employed, in the undercut, to secure the discs 62 in the cavity 32 in engagement with the threaded wall of the bit head 14. The spacer 66 has outermost portions which define a greatest outside diameter (B) that is greater than the diameter (D) of the upper stabilizing bore 34 but less than the low stress undercut diameter (A). The discs 62 are assembled into the bit head 14 and the retaining spacer 66 is temporarily deformed. The aforesaid outermost portions thereof are bent at an angle to reduce the effective greatest diameter, of the spacer 66, to one which can be accommodated through the bore 34. Then the spacer 66 is pressed through the upper stabilizing bore 34 and reformed to a flat configuration, in undercut 64, and on top of the discs 62. As the greatest outside diameter of the inserted, reformed, retaining spacer 66 is greater than the diameter of upper stabilizing bore 34 an interference condition exists that provides for the retention of the spacer 66 and discs 62 in the bit head 14. The location of the low stress undercut 64 is such that the inserted, in-place, retaining spacer 66 also serves as the top disc.

The correct sizing of the lower cylindrical bore 38, the latter comprising a lower stabilizing bearing bore, in the bit head 14, is essential to provide an optimum axial restraint on the discs 62 and spacer 66 that is necessary for the correct functioning of the threaded connection. Thus, it is essential that the depth "C" of the cavity 32, from the uppermost open or terminal end thereof, to the bit head shoulder, or disc bearing surface 60, must exceed 0.45 times the diameter, "D", of the bore, or upper stabilizing surface 34, and the depth "L" of the lower, cylindrical, stabilizing bearing bore 38 exceed 0.05 times the diameter, "D" of bore 34.

As can be seen in FIG. 3, the discs 62 present individual, rigid surfaces 68 to the confronting threads 26 and 36. Said surfaces 68 are parallel to the axis 70 of the bit head 14. The discs 62 are all identical, having common outside and inside diameters, and each is freely rotatable, in the cavity 32. The threads 26 and 36 have a given lead dimension and the discs 62 each have a thickness which is approximately one eighth of the lead dimension. In this exemplary embodiment the aforesaid thickness is substantially the lead dimension divided by 8.3.

Figure 5:
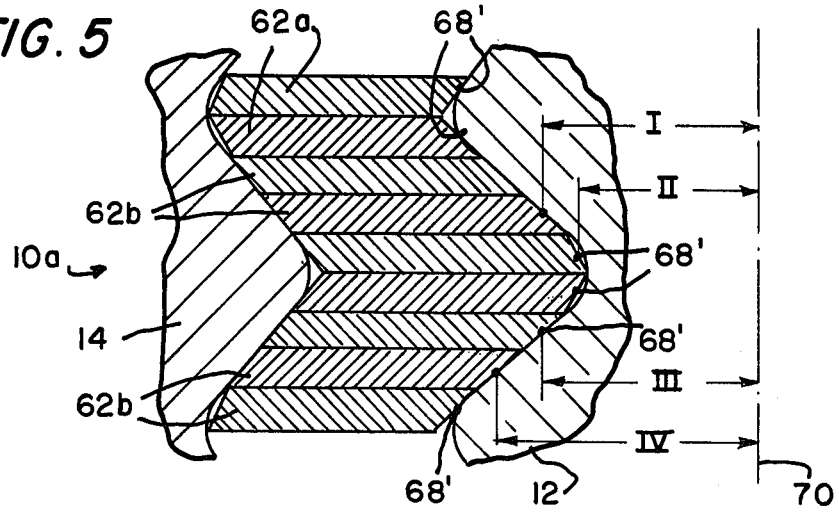
FIG. 5 is an illustration, similar to that of FIG. 3, of an alternative embodiment of the invention.

FIG. 5, similar to FIG. 3, depicts an alternative embodiment 10*a* of the invention. Here the discs 62*a* and 62*b* are of discrete conformations and dimensions. They have thread confronting surfaces which more nearly reflect the thread forms which they interface. However, it is an embodiment which is expensive of manufacture, and which yields no advantage over that of the FIGS. 1 through 4 embodiment 10. Too, discs 62*a* and 62*b* must be stacked in a proper sequence and turned from an obverse to a reverse side for differing positionings thereof. This embodiment 10*a* is depicted only to recognize that any such arrangement is possible, if not practical, and is within the ambit of this invention.

It is a criterion of the invention that the surfaces 68 mate with the confronting threads 26 and 36. More, the median 68' of any one of the surfaces 68 shall be at a given radial distance from the axis 70 of the bit head which is different from the radial distance, from the axis 70, of one other such surface 68 immediately adjacent thereto. As FIG. 5 depicts, the embodiment 10*a* meets this criterion; medians 68' of adjacent discs 62*a* and 62*b* are at diverse distances "I" and "II", and distances III and IV, from the axis 70.

The embodiments 10 and 10*a* of the invention, of FIG. 1–5, for example, define an improved bit head and an improved, plural-part earth bit, of the types used in rotary and impacting earth boring. With reference to FIG. 1 and 3, then it will be appreciated that the embodiment 10 will accommodate impacting forces. The annular width, "aw", of the discs 62 is greater than the depth 42 of the thread 36. Hence, between the outermost reaches or crests of the threads 26 and 36, there obtains a direct axially-extended column, "ac", of stacked metal for sustaining the compressive, impacting forces. When a bit head, or a plural-part earth bit will be used only for drilling, it will not be necessary to define a clear, axially-extended column of metal. In the latter application, it is necessary only to interpose means, of any annular width, bridging between the threads 26 and 36 which will uniformly transfer torque therebetween. The embodiment 10*b* in FIG. 6, showing only fragmentary portions of the shank 12 and bit head 14, is illustrative of this latter practice of the invention.

FIG. 6 is a part cross-sectional view of the shank 12 and bit head 14, each threaded with threads 26*a* and 36*a*, respectively. Interposed between the threads is an element 72. The latter, as the cross-section shows, defines a plurality of separate, rigid, surmounting and radially-oriented surfaces 68*a* along lead lengths of the threads 26*a* and 36*a*. Clearly, a stack of apertured discs, like discs 62, could be employed. However, in this embodiment, element 72 is a helical, spring-like component.

The aforesaid, and other modifications and refinements of our invention, as will occur to others by taking teaching from our disclosure, are deemed to be within the ambit of our invention and embraced by the following claims.

Thus, while we have described our invention in connection with specific embodiments thereof, it is to be clearly understood that this is done only by way of example and not as a limitation to the scope of our invention, as set forth in the objects thereof, and in the appended claims.

We claim:

1. An improved bit head, for a plural-part earth bit, said head having a central axis, and an axially-extended cavity formed therein; said cavity defining a first wall, substantially smoothly threaded and of a given pitch diameter, which circumscribes said axis, wherein the improvement comprises:

means lining said first wall defining a second, threaded wall which circumscribes said axis, said defined second wall having a thread with a pitch diameter which is less than said given diameter; wherein said lining means comprises means which, along a given radial plane drawn outwardly from said axis, defines a plurality of lamina;

each lamina of said plurality, along said given plane, terminates radially inwardly in an individual, rigid, surface of a given axial dimension;

the median of any one of said individual surfaces, of a plurality of said surfaces, measured along said given radial plane, is disposed at a given radial distance from said axis; and the median of another such surface immediately adjacent to said any one individual surface, measured along said plane, is disposed at a radial distance from said axis other than said given distance.

2. An improved bit head, for a plural-part earth bit, according to claim 1, wherein:

said individual surfaces are all parallel with said axis.

3. An improved bit head, for a plural-part earth bit, according to claim 1, wherein:

said lining means comprises a plurality of apertured discs.

4. An improved bit head, for a plural-part earth bit, according to claim 3, wherein:

said discs all have a common outside diameter and a common inside diameter.

5. An improved bit head, for a plural-part earth bit, according to claim 3, wherein:

said first wall has a thread lead of a given dimension X; and each of said discs has a thickness of approximately X/8.

6. An improved bit head, for a plural-part earth bit, according to claim 1, wherein:

said cavity and lining means have means cooperative for retaining said lining means within said cavity.

7. An improved bit head, for a plural-part earth bit, said head having a central axis, and an axially extended, circumferential, first wall, which circumscribes said axis, said first wall having a thread of a given pitch diameter, wherein in the improvement comprises:

means lining said first wall defining a second, threaded wall, circumscribing said axis, having a pitch diameter which is less than said given diameter; wherein said lining means comprises a plurality of individual, rigid, circular elements; and each of said elements of said plurality is freely rotatable relative to any other thereof.

8. An improved bit head, for a plural-part earth bit, according to claim 7, wherein a plurality of said elements are substantially identical.

9. An improved bit head, for a plural-part earth bit, said head having a central axis, and an axially extended, circumferential, first wall, which circumscribes said axis, said first wall having a thread of a given pitch diameter, wherein in the improvement comprises:

means lining said first wall defining a second, threaded wall, circumscribing said axis, having a pitch diameter which is less than said given diameter; wherein said lining means comprises a plurality of individual, rigid, circular elements;

each of said elements of said plurality is freely rotatable relative to any other thereof;

each of said elements has an aperture formed therethrough centrally thereof;

said apertures of a given plurality of said elements are of a common dimension; and a plurality of said apertures are eccentrically disposed relative to said axis.

10. An an improved bit head for a plural-part earth bit, according to claim 1, wherein:

said first wall and lining means have means cooperative for retaining said elements within said bit head.

11. An improved bit head, for a plural-part earth bit, according to claim 10, wherein;

said cooperative retaining means comprises a retainer; said bit head has a cavity formed therein; and said cavity has means for securing said retainer therewithin.

12. An improved bit, head, for a plural-part earth bit, according to claim 11, wherein:

said securing means comprises a relief formed in said cavity.

13. An improved bit head, for a plural-part earth bit, according to claim 7, wherein:

said first wall has a bearing surface lying normal to said axis; and said plurality of elements is walled-in, in said bit head, by said bearing surface.

14. An improved bit head, for a plural-part earth bit, according to claim 11, wherein:

said cavity has means defining a first stabilizing surface of a given diametrical dimension, D, and means defining a second stabilizing surface of a diametrical dimension less than said given diametrical dimension, D;

said second stabilizing surface has a prescribed axial length, L; and said prescribed axial length, L, is of a dimension which exceeds one-twentieth of said given diametrical dimension, D.

15. An improved bit head, for a plural-part earth bit, according to claim 11, wherein:

said cavity (a) has an open end, (b) defines a bearing surface, lying normal to said axis, at a given distance, C, from said open end, (c) defines a first stabilizing surface of a given diameter, D, and (d) defines a second stabilizing surface, spaced apart from said first stabilizing surface, having a prescribed axial length, L; and said given distance, C, exceeds 0.45 times said given diameter, D, and said length, L exceeds 0.05 times said given diameter, D.

16. An improved bit head, for a plural-part with bit, according to claim 9, wherein:

said elements of said given plurality thereof have a common outside diameter, and a common annular width defined by and between said outside diameter and said apertures therein;

said first wall has a thread with a given depth; and said annular width of said elements is greater than said given depth.

17. An improved bit head, for a plural-part earth bit, said head having a central axis, and an axially-extended, circumferential, first wall, which circumscribes said axis, said first wall having a thread of a given pitch diameter, wherein in the improvement comprises:

means lining said first wall defining a second, threaded wall, circumscribing said axis, having a thread with a pitch diameter which differs from said given diameter; wherein said lining means comprises a plurality of individual, rigid, circular elements; and each of said elements of said plurality is freely rotatable relative to any other thereof.

18. An improved bit head, for a plural-part earth bit, according to claim 17, wherein a plurality of said elements are substantially identical.

19. An improved bit head, for a plural-part earth bit, said head having a central axis, and an axially-extended, circumferential, first wall, which circumscribes said axis, said first wall having a thread of a given pitch diameter, wherein in the improvement comprises:

means lining said first wall defining a second, threaded wall, circumscribing said axis, having a thread with a pitch diameter which differs from said given diameter; wherein said lining means comprises a plurality of individual, rigid, circular elements;

each of said elements of said plurality is freely rotatable relative to any other thereof;

each of said elements has an aperture formed therethrough centrally thereof;

said apertures of a given plurality of said elements are of a common dimension; and a plurality of said apertures are eccentrically disposed relative to said axis.

20. An improved, plural-part, earth bit, comprising a bit shank having a threaded end, and a bit head, said head having a central axis, and an axially-extended, circumferential, first wall, which circumscribes said axis, said first wall having a thread with a given pitch diameter, wherein the improvement comprises:

means lining and engaging said first wall defining a second, threaded wall, which circumscribes said axis, and which threadedly engages said threaded end of said shank;

said defined second wall having a thread with a pitch diameter which differs from said given diameter, wherein said lining means comprises means which, along a given radial plane drawn outwardly from said axis, defines a plurality of lamina;

each lamina of said plurality, along said given plane, terminates radially inwardly in an individual, rigid surface of a given axial dimension;

the median of any one of said individual surfaces, of a plurality of said surfaces, measured along said given radial plane, is disposed at a given radial distance from said axis; and the median of another such surface immediately adjacent to said any one individual surface, measured along said plane, is disposed at a radial distance from said axis other than said given distance.

21. An improved, plural-part, earth bit, according to claim 20, wherein:

said individual surfaces are all parallel with said axis.

22. An improved, plural-part, earth bit, according to claim 20, wherein:

said lining means is formed of a plurality of apertured discs.

23. An improved, plural-part, earth bit, according to claim 22, wherein:

said discs all have a common outside diameter and a common inside diameter.

24. An improved, plural-part, earth bit, according to claim 22, wherein:

said thread of said first wall has a thread lead of a given dimension X; and each of said discs has a thickness of approximately X/8.

25. An improved, plural-part, earth bit, according to claim 20, wherein:

said bit head and lining means have means cooperative for retaining said lining means in engagement with said first wall.

26. An improved, plural-part, earth bit, comprising a bit shank which is threaded along a portion thereof, and a bit head, said head having a central axis, and an axially extended, circumferential, first wall, which circumscribes said axis, said first wall having a thread of a given pitch diameter, wherein in the improvement comprises:

means lining and engaging said first wall defining a second threaded wall which circumscribes said axis, and which threadedly engages said threaded portion of said shank;

said defined second wall having a thread with a pitch diameter which differs from said given diameter; wherein said lining means comprises a plurality of lamina;

each lamina of said plurality presents an individual, rigid, circular surface circumscribing said axis; and each of said laminae is rotatable relative to any other thereof.

27. An improved, plural-part, earth bit, according to claim 26, wherein:

a given plurality of said laminae are substantially identical.

28. An improved, plural-part, earth bit, comprising a bit shank which is threaded along a portion thereof, and a bit head, said head having a central axis, and an axially extended, circumferential, first wall, which circumscribes said axis, said first wall having a thread of a given pitch diameter, wherein in the improvement comprises:

means lining and engaging said first wall defining a second threaded wall which circumscribes said axis, and which threadedly engages said threaded portion of said shank;

said defined second wall having a thread with a pitch diameter which differs from said given diameter; wherein said lining means comprises a plurality of lamina;

each lamina of said plurality presents an individual, rigid, circular surface circumscribing said axis;

each of said laminae is rotatable relative to any other thereof;

each lamina of said plurality thereof has an aperture formed therethrough centrally thereof;

said apertures of a given plurality of said laminae are of a common dimension; and a plurality of said common-dimension apertures are eccentrically disposed relative to said axis.

29. An improved, plural-part, earth bit, according to claim 26, wherein:

said bit head and lining means have means cooperative for retaining said laminae in lined engagement with said first wall.

30. An improved, plural-part, earth bit, according to claim 26, wherein:

said first wall has a bearing surface lying normal to said axis; and said laminae are held against axial removal from said bit head by said bearing surface.

31. An improved, plural-part, earth bit, according to claim 26, wherein:

said first wall has means defining a first shank stabilizing surface of a given diametrical dimension and means defining a second shank stabilizing surface of a diametrical dimension less than said given dimension;

one of said first and second stabilizing surfaces has a prescribed axial length; and said prescribed axial length is of a dimension which is more than one-twentieth of said given diametrical dimension.

32. An improved, plural-part, earth bit, comprising a bit shank which is threaded along a portion thereof, and a bit head, said head having a central axis, and an axially extended, circumferential, first wall, which circumscribes said axis, said first wall having a thread of a given pitch diameter, wherein in the improvement comprises:

means lining and engaging said first wall defining a second threaded wall which circumscribes said axis, and which threadedly engages said threaded portion of said shank;

said defined second wall having a thread with a pitch diameter which differs from said given diameter; wherein said lining means comprises a plurality of lamina;

each lamina of said plurality presents an individual, rigid, circular surface circumscribing said axis;

each of said laminae is rotatable relative to any other thereof; and said first wall (a) has a terminal end, (b) defines a bearing surface, lying normal to said axis, at a given distance, C, from said terminal end, (c) defines a first stabilizing surface of a given diameter, D, and (d) defines a second stabilizing surface, spaced apart from said first stabilizing surface, having a prescribed axial length, L; and said given distance, C, exceeds 0.45 times said given diameter, D, and said length, L, exceeds 0.05 times said given diameter, D.

33. An improved, plural-part, earth bit, according to claim 28, wherein:

said laminae of said given plurality thereof have a common outside diameter, and a common annular width defined by and between said outside diameter and said apertures therein;

said first wall has a thread with a given depth; and said annular width of said elements is greater than said given depth.

* * * * *